United States Patent [19]

Houle et al.

[11] Patent Number: 5,031,343

[45] Date of Patent: Jul. 16, 1991

[54] MOUNTING BRACKET FOR SIDE WING PLOW

[75] Inventors: Bertrand Houle; Guy Lamoureux, both of Drummondville; Jacques De Billy, St-Valerien, all of Canada

[73] Assignee: Tenco Machinery Ltd., Shefford, Canada

[21] Appl. No.: 454,268

[22] Filed: Dec. 21, 1989

[51] Int. Cl.[5] ..... E01H 5/06

[52] U.S. Cl. ..... 37/231; 37/236; 37/279; 172/451

[58] Field of Search ..... 37/105, 218, 235, 236, 37/231, 279, 280, 281, 282, 283, 284; 172/451

[56] References Cited

U.S. PATENT DOCUMENTS

| | | | |
|---|---|---|---|
| 2,121,960 | 6/1938 | Frink | 37/236 |
| 2,332,712 | 10/1943 | Gustafson et al. | 37/235 |
| 3,130,654 | 4/1964 | Apel et al. | 37/105 |
| 4,045,892 | 9/1977 | Farrell | 37/236 |
| 4,357,766 | 11/1982 | Croteayu et al. | 37/281 |
| 4,744,159 | 5/1988 | Houle | 37/236 X |

FOREIGN PATENT DOCUMENTS

| | | |
|---|---|---|
| 959258 | 12/1974 | Canada . |
| 1082454 | 7/1980 | Canada . |

*Primary Examiner*—Dennis L. Taylor
*Assistant Examiner*—Arlen L. Olsen
*Attorney, Agent, or Firm*—Samuel Meerkreebs

[57] ABSTRACT

A mounting bracket for mounting the rear post of a side wing plow is provided wherein the bracket is adapted to be mounted to the frame of the snow plowing vehicle. The side wing plow includes a rear post with a carriage for mounting the side wing plow. At least a semi-cylindrical member is located on the post on the opposite side and it has a longitudinal axis parallel to the post. The bracket mounted to the vheicle frame includes at least a concave arcuate seat member having a vertical axis for receiving the semi-cylindrical member such that the post can be rotated through a definite angle in the arcuate seat and the semi-cylindrical members are welded in the seat at an angle which has been selected for the particular vehicle on which the side wing plow has been mounted.

8 Claims, 1 Drawing Sheet

10
12
14
16
18
18a
18b
18c
20
22
24
25
26
27
28
30
32
34
36
38
40
42
44
46
48
50
52
2
124
126
127
128
130
138

MOUNTING BRACKET FOR SIDE WING PLOW

BACKGROUND OF THE INVENTION

1. Field of the Invention

The present invention relates to snow plows, and more particularly, to a mounting means for a side wing plow.

2. Description of the Prior Art

Side wing plows of the type described in U.S. Pat. No. 4,357,766, issued Nov. 9, 1982 to Croteau et al, have a forward side wing mounting bracket or post located near the front end of the vehicle and a rear mounting post located generally behind the cab of the vehicle. A mounting frame is generally mounted to the frame of the vehicle for mounting the rear post of the side wing plow. The front bracket can either be mounted to a front plow mounting frame or to an extension of the vehicle frame. In any event, the vehicles on which the side wing plow must be assembled vary in dimensions from model to model. The vehicle frame can be higher or lower, and the distance between the front end of the vehicle and the location of the rear post can vary depending on the location of the cab and other accessories.

Thus, the distance between the front and rear posts when assembling the side wing assembly can vary, and the angle of the plane including the side wing blade support arms and the rear post relative to the axis of the vehicle and the side wing blade will change, thus requiring customizing of the rear post mounting frame in order to accommodate the angle of the plane and thus the rear post. It is evident that the rear post must be mounted such that the carriage is in line with the side wing support arms:

SUMMARY OF THE INVENTION

It is an aim of the present invention to provide an improved side wing plow assembly and mounting frame which will provide a universal mounting arrangement capable of fitting most snow plow mounting vehicles.

It is a further aim of the present invention to provide a simple, adaptable, side wing plow rear post mounting bracket.

A construction in accordance with the present invention comprises a mounting bracket for mounting a rear post of a side wing plow, wherein the bracket is adapted to be mounted to a frame of a snow plowing vehicle. The side wing plow includes a rear post defining, on one side, means for mounting the side wing plow. At least a semi-cylindrical member is located on the post on the opposite side having a longitudinal axis parallel to the post. The bracket mounted to the vehicle frame includes at least a concave arcuate seat member having a vertical axial axis for receiving the semi-cylindrical member such that the post can be rotated through a definite angle in the arcuate seat, and fastening means are provided for mounting the post at a selected angle within the seat member Thus, a side wing plow can be mounted to a snow plowing vehicle, wherein the side wing plow has means for mounting the front end of the plow to the front of the vehicle, and a rear post is provided having a track, a carriage slidable vertically on the track, and support arms extending from the carriage to the plow. The carriage could be a fixed bracket. The rear post can be seated in the arcuate seat of the rear post support bracket with the rear post disposed at an angle aligned with the support arms. The post may be fastened, to the one or more arcuate seats, by welding.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 2, 3:
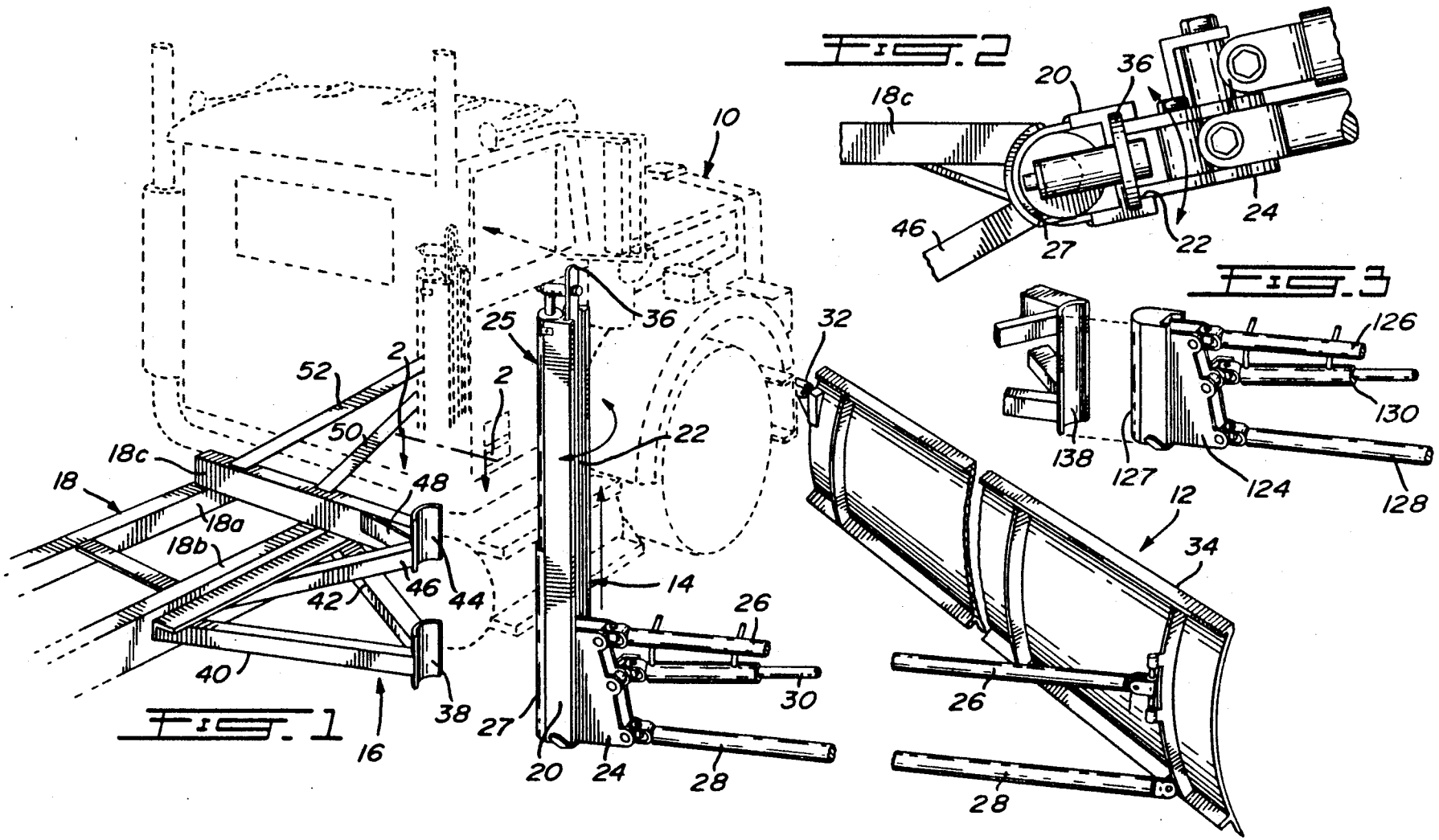
FIG. 1 is a fragmentary exploded perspective view of an arrangement in accordance with the present invention.
FIG. 2 is a horizontal cross-section taken along line 2—2 of FIG. 1.
FIG. 3 is a fragmentary, exploded, perspective view showing another embodiment of the present invention.

Referring now to the drawings, there is shown in dotted lines a truck 10 which is adapted to mount a side wing plow assembly 12. The side wing assembly 12 includes at least a rear post 14 which is mounted to the truck frame 18 by means of the support bracket 16.

The post 14 includes a vertically extending I-beam member 20 and defining a track 22 in which a carriage 24 will travel The side wing assembly and post are similar to those described in U.S. Pat. No. 4,357,766, issued Nov. 9, 1982. The carriage 24 is operated in the track 22 by means of a lift mechanism which includes a piston and cylinder arrangement 25 connected to a lift 36 above the I-beam 20. The piston and cylinder arrangement 25 is mounted on the rear of the I-beam 20 and is partially covered by a semi-cylindrical plate 27. The semi-cylindrical plate 27 is welded to the flanges of the I-beam 20, as shown in FIG. 2.

The side wing plow 34 is pivotally mounted at its forward end by means of a bracket 32 on the front end of the truck 10 while support arms 26 and 28 extending from the carriage 24 support the rear end of the plow 22. These support arms 26 and 28 may be articulated to the end of the plow 34 in a manner similar to that described in U.S. Pat. No. 4,357,766. A piston and cylinder member 30 extends between the carriage 24 and the mid-point of the support arm 26 in order to operate the quadrilateral structure formed by the support arms 26 and 28 with the carriage 24 and the plow 34.

The support bracket 16 includes at least a pair of concavely arcuate seats 38 and 44 which are aligned parallel to a vertical axis. These seats are mounted respectively to support arms 40, 42 and 46, 48. The seat 44 in the present embodiment is shown as being connected to the end of an extension of truck frame 18*c*. Other seats similar to seats 38 and 44 may be provided. In the present embodiment, the seats 38 and 44 have a vertical extent which does not exceed the length of the semi-cylindrical plate 27 mounted to the post 14.

When it is required to mount the side wing plow to a truck or other snow plow mounting vehicle, the front end of the snow plow may be mounted to a bracket 32. However, the distance between the bracket 32 and the possible location of the rear post 14 may vary depending on the size of the truck. Since the snow plow blade 34 has a fixed length, the angle between the plane which includes the support arms 26 and 28, carriage 24, and the post 14, and the side plow 34 on the other hand, can vary. The post 14 can be adjusted angularly, therefore, in the seats 38 and 44. The radius of the seats 38 and 44 corresponds to the radius of the semi-cylindrical plate 27 to receive the plate 27. Once the angle which the post 14 should assume has been selected, the semi-cylindrical plate 27 can be welded to the concave seats 38 and 44.

It can be seen, therefore, that the side wing plow assembly can be accommodated on several different trucks with varying distances between the bracket 32 and the possible location of the post 14; thus, the post need merely be angled relative to the seats 38 and 44 and be welded thereto.

The semi-cylindrical plate 27 can be provided in segments or cover the whole of the rear of the I-beam 20. The seats 38 and 44 can be one piece or several pieces spaced apart vertically and parallel to the axis of the post to be received.

In the embodiment shown in FIG. 3 the carriage 124 is shown as being fixed. That is it does not slide in a track. Thus, rather than have a post with a track and a piston and cylinder arrangement, the carriage 124 or similar bracket would include a rear arcuate plate 127 adapted to be mounted in the arcuate seat 138.

Referring back to FIG. 1 the post 20 could have different cross-sectional shapes such as: instead of being an I-beam as shown in the present embodiment the post 20 could be in the form of a channel to accommodate the sliding carriage 24 with arcuate plate 27 welded to the back of the channel.

We claim:

1. A side wing plow assembly, including a rear mounting bracket adapted to be mounted to the frame of a snow plowing vehicle rearwardly of the cab of the vehicle and a front mounting bracket, the side wing plow including means for mounting the front end thereof to the front end mounting bracket, means for mounting the rear end of the side plow including a rear post defining, on one side, a track means and a traveling carriage mounted on the track means for vertical sliding movement thereon, and a piston and cylinder arrangement on the post on the opposite side of the track means extending upwardly from the base of the post, support arms extending from the traveling carriage to the end of the side wing plow blade for supporting the end of the plow, characterized in that at least a semi-cylindrical member is located on the post on the opposite side having a longitudinal axis parallel to the post, and the semi-cylindrical member encompasses at least a portion of the piston and cylinder arrangement, said rear mounting bracket including at least a concave arcuate seat member having a vertical axial axis adapted to receive the semi-cylindrical member such that the post can be rotated through a definite angle in the arcuate seat, and fastening means being provided for mounting the post at a selected angle with the seat member.

2. An apparatus as defined in claim 1, wherein there are at least two vertically aligned concave arcuate seat members on the support bracket adapted to receive the semi-cylindrical plate mounted on the post for mounting the post in a vertical axis.

3. An apparatus as defined in claim 2, wherein the post includes a vertical I-beam member defining the track on one side and mounting the cylinder and piston arrangement on the other side and the semi-cylindrical plate member being welded to the flanges of the I-beam.

4. An apparatus as defined in claim 2 wherein the post is at least a channel member defining the track for the carriage and the semi-cylindrical member is welded to the rear of the post.

5. An apparatus as defined in claim 1 wherein the fastening means is a weld.

6. A method for mounting a side wing plow assembly, including providing mounting brackets forward and rearwardly of the cab of a snow plow vehicle, mounting the front end of the side wing plow to the front mounting bracket, providing the rear mounting bracket with a concave arcuate seat member having a vertical axis, the end of the side wing plow being mounted on a carriage means and providing a semicircular member with a vertical axis on the carriage means, mounting the semicircular member of the carriage means in the concave arcuate member of the bracket means, and adjusting the angle of the carriage and semicircular member to a selected angle of support arms extending from the carriage mounting the end of the side wing plow, and fixing by welding the semicircular member in the concave arcuate mounting bracket.

7. A side wing plow assembly, including a mounting bracket adapted to be mounted to the frame of a snow plow vehicle rearwardly of the cab of the vehicle and a front mounting bracket, the side wing plow including means for mounting the front end thereof to the front end mounting bracket, means for mounting the rear end of the side plow including a carriage assembly means, the carriage assembly means including an upstanding elongated post including on the front thereof a track on which a carriage can slide and a semi-cylindrical member mounted to the rear of the post, and support arms extend from the carriage to the end of the side wing plow blade for supporting the end of the plow, said rear mounting bracket including at least an elongated concave arcuate seat member having a vertical axis adapted to receive the semi-cylindrical member, whereby the carriage assembly means can be rotated through a definite angle in the arcuate seat so that the carriage can be aligned with the support arm at a selected angle and fastening means provided for mounting the semi-cylindrical member and thus the carriage at the selected angle with the seat member.

8. An apparatus as defined in claim 7 wherein the fastening means is a weld.

* * * * *